United States Patent [19]

Fletcher

[11] 4,175,611

[45] Nov. 27, 1979

[54] PLASMA FLAME SPRAY COATED GRAPHITE DIES

[75] Inventor: John M. Fletcher, Sheffield, England

[73] Assignee: British Steel Corporation (Chemicals) Limited, England

[21] Appl. No.: 900,561

[22] Filed: Apr. 27, 1978

[30] Foreign Application Priority Data

Apr. 28, 1977 [GB] United Kingdom ..... 17804/77

[51] Int. Cl.[2] ..... B05D 3/06; B05D 7/24; B32B 15/04; B32B 9/04

[52] U.S. Cl. ..... 164/418; 164/138; 427/34; 427/133; 427/423; 428/552; 428/640; 428/654; 428/469; 428/457

[58] Field of Search ..... 427/34, 423, 190, 191, 427/199, 133, 113; 164/72, 82, 138, 418

[56] References Cited

U.S. PATENT DOCUMENTS

| | | | |
|---|---|---|---|
| 2,775,531 | 12/1956 | Montgomery et al. | 427/423 |
| 2,992,127 | 7/1961 | Jones | 427/190 |
| 3,091,548 | 5/1963 | Dillon | 427/34 |
| 3,266,107 | 8/1966 | Groike | 164/72 |
| 3,366,464 | 1/1968 | Guichet et al. | 427/34 |
| 3,515,201 | 6/1970 | Zimmerman | 164/72 |

*Primary Examiner*—John H. Newsome
*Attorney, Agent, or Firm*—Bacon & Thomas

[57] ABSTRACT

The invention relates to a method of producing a graphite die for use in continuous casting of non-ferrous metals. The die has wearing surfaces which, in accordance with the invention, are coated, using either plasma-combustion flame or liquid-spraying techniques, with a first layer consisting of a metal or a metal plus a ceramic material and then with a second layer of ceramic material. The coating materials are applied as a suspension in a liquid medium by painting or spraying techniques or they must be applied by plasma or combustion flame spraying techniques.

The first layer may comprise one or more of the following substances: silicon, iron, nickel, chromium, molybdenum, tungsten or their alloys or any other metal which can be subsequently carburized by heating with graphite in an inert or reducing atmosphere.

Alternatively the first layer may be either aluminium, an aluminium alloy, an aluminium-metal composite or a mixture of the metal(s) and alumina and the second layer is preferably alumina.

The second layer is selected from titania, chromia, zirconia, silica, magnesia or mixed oxides such as zirconium silicate, magnesium zirconate, mullite, silliminite, refractory carbides such as boron carbide, silicon carbide, chromium carbide; refractory borides such as zirconium or titanium diboride; or refractory nitrides such as silicon nitride.

When the final coating has been applied, the coatings are sintered or baked in an inert atmosphere.

9 Claims, 3 Drawing Figures

PLASMA FLAME SPRAY COATED GRAPHITE DIES

This invention relates to graphite dies of the type which are used in the continuous casting of non-ferrous metals, such as cupro-nickel alloys, brass, bronze, nickel silver etc. In using such dies the metal to be cast is melted, usually in an electric furnace, and the molten metal is caused to flow into a water-cooled die in a continuous stream; where it solidifies and emerges as a continuously cast rod or bar.

In many applications it is important to obtain a high surface finish on the continuously cast bar or rod.

To achieve this the dies are often made of high density graphite, and such dies are expensive.

In use the dies tend to wear out very quickly and an object of this invention is to provide a method of manufacturing such dies so as to produce a die which has hard wearing surfaces, thus considerably lengthening the life of the dies.

In accordance with the invention the wearing surfaces of a graphite die intended for use in continuous casting of non-ferrous metals are coated with a first layer consisting of a metal or a metal plus a ceramic material and then with a second layer of a ceramic material. Although the materials can be applied as a suspension in a liquid medium by painting or spraying techniques, plasma or combustion flame spraying are preferred techniques since physical or chemical bonding of the metal with the graphite surface can be obtained directly.

Preferably, the first layer is either aluminium, an aluminium alloy, an aluminium-metal composite such as METCO 450 Ni-Al commercially available from METCO Inc or a mixture of the metal(s) and alumina and the second layer is preferably alumina.

Other metals which might be used for the first layer are silicon, iron, nickel, chromium, molybdenum, tungsten or their alloys or any other metal which can be subsequently carburised by heating with graphite in an inert or reducing atmosphere.

Other ceramic materials which might be used for the second layer are titania, chromia, zirconia, silica, magnesia or mixed oxides such as zirconium silicate, magnesium zirconate, mullite, silliminite; refractory carbides such as boron carbide, silicon carbide, chromium carbide; refractory borides such as zirconium or titanium diboride; or refractory nitrides such as silicon nitride.

The second layer may be applied in two stages, using a coarse grade of ceramic such as alumina either alone or as a mixture with aluminium for the first coat and then a fine grade of alumina for the top coat. The coarse grade would have particles able to pass through a British Standard Sieve Size 100 and the fine grade might have particles able to pass through a British Standard Sieve Size 300.

Figure 1:
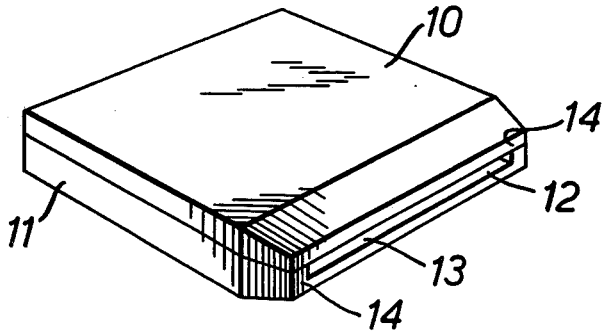
Figure 2:
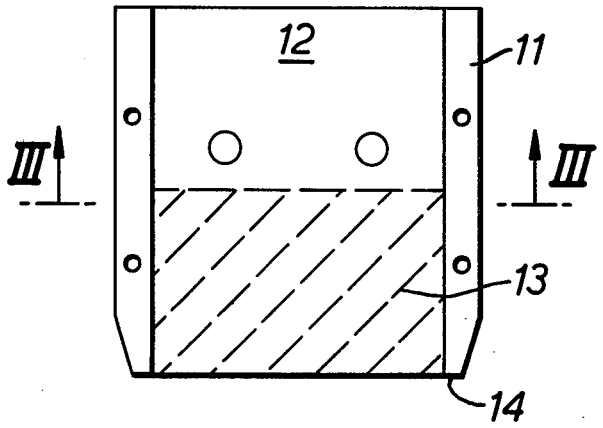
Figure 3:
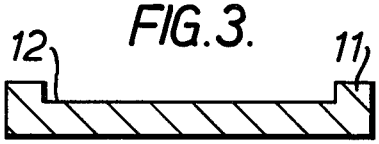

In the accompanying drawing is shown a graphite die for a non-ferrous continuous casting process, FIG. 1 is an isometric view of the die, FIG. 2 is a plan view of half the die showing its inside surfaces, and FIG. 3 is a section on line III—III of FIG. 2.

The die shown in FIG. 1 consists of two parts 10 and 11, each machined from high density graphite. The shape of these two parts is such that between them they form a channel 12 into which molten metal is caused to flow. The molten metal hardens as it flows through the die and is relatively hard by the time it reaches approximately half way along the die. In a continuous casting process the metal is drawn out of the far end of the die in a continuous bar which may be approximately 8" by ½" in dimension. Subsequently the bar may be rolled into sheets for example to make coins which are then stamped out from the sheets.

In use the first half of the die surface, marked 13 and 14 in FIG. 2 rapidly becomes eroded and worn because this is where the metal is molten and very hot.

In accordance with the invention at least the first half of the bottom and top die surfaces and also the front edges 14 are coated with a wear resistant layer by thermal and/or liquid coating techniques.

The following are examples of the application of the invention:

EXAMPLE 1

The half graphite die shown in FIG. 2 was masked so that only the areas marked 13 and 14 were exposed. A mixture of aluminium and alumina consisting of 50% aluminium and 50% alumina was then sprayed on to the area 13 using a plasma spray gun of the type made by Metco Inc and designated by Metco as Type 7M. Using this plasma spray gun a layer of aluminium/alumina of thickness between 3 and 5 thousandths of an inch was applied. Then a second layer of coarse grade alumina (able to pass through a British Standard Sieve No 100) was applied giving a second layer thickness of maximum 10 thousandths of an inch. A third and final coat was then applied consisting of fine grade alumina (able to pass through a British Standard Sieve No 300) to a thickness of not more than 5 thousandths of an inch.

EXAMPLE 2

Same system was used except that the first layer is aluminium, the second layer a 50:50 mix of aluminium and alumina and the third layer alumina.

In each of these Examples the final layer of alumina may be replaced by alumina containing 2% titania to give a harder finish.

In each case when the final coating has been applied the coatings are sintered or baked in an inert atmosphere in an electric furnace. The baking is carried out at a temperature of up to 1500° C. for up to 60 minutes. Specifically the coating may be baked for one hour at 800° C. or, for example, 20 minutes at 1300° C. A final grinding or polishing operation may be introduced in order to remove any surface defects.

By using this process not only is the life of the die improved, but the graphite used for the die may be a cheaper and less dense material. We have found that using an aluminium primary layer with an alumina second layer, we obtain better adhesion and thermal shock resistance than is obtained by spraying alumina directly on to the graphite. In some instances particularly when using thermal spraying techniques we have found that it is not essential to increase the bonding by sintering as described above.

We claim:

1. A method of producing a graphite die for use in continuous casting of non-ferrous metals, the graphite die having wearing surfaces, said method comprising applying a first layer of aluminum or a mixture of aluminum and alumina and then applying a second layer of alumina, both layers being applied by plasma or combustion flame spraying.

2. The method of claim 1 in which the first layer is applied to a thickness of between 0.003 and 0.005 inches and the second layer is applied to a thickness of not more than 0.01 inch.

3. A method according to claim 1 in which the second layer is applied in two stages, the first of said stages using a coarse grade of ceramic alone or mixed with aluminium and then a fine grade of ceramic for the second of said stages.

4. A method according to claim 3 in which the ceramic is alumina.

5. A method according to claim 3 in which the coarse grade has particles able to pass through British Standard Sieve size 100 and the fine grade has particles able to pass through British Standard Sieve size 300.

6. A method according to claim 2 in which, when the final coating has been applied, the coatings are sintered or baked in an inert atmosphere.

7. A method according to claim 6 in which the baking is carried out at a temperature not greater than 1500° C. for up to 60 minutes.

8. A method according to claim 6 in which the coated die is subjected to a final grinding or polishing operation to remove any surface defects.

9. A graphite die having wearing surfaces produced in accordance with the method of claim 2.

* * * * *